US008222803B2

(12) United States Patent
Katsuraya et al.

(10) Patent No.: US 8,222,803 B2
(45) Date of Patent: Jul. 17, 2012

(54) SPARK PLUG AND MANUFACTURING METHOD THEREOF

(75) Inventors: Kohei Katsuraya, Nagoya (JP); Katsutoshi Nakayama, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/123,408

(22) PCT Filed: Oct. 9, 2009

(86) PCT No.: PCT/JP2009/005285

§ 371 (c)(1), (2), (4) Date: Apr. 8, 2011

(87) PCT Pub. No.: WO2010/044238

PCT Pub. Date: Apr. 22, 2010

(65) Prior Publication Data

US 2011/0193470 A1 Aug. 11, 2011

(30) Foreign Application Priority Data

Oct. 16, 2008 (JP) ..... 2008-267452

(51) Int. Cl.

| | |
|---|---|
| ***H01T 13/28*** | (2006.01) |
| ***H01T 13/20*** | (2006.01) |
| ***H01T 21/00*** | (2006.01) |
| ***H01T 21/02*** | (2006.01) |

(52) U.S. Cl. ..... 313/141; 313/142; 313/143; 445/7

(58) Field of Classification Search ..... 447/7; 313/141–145; 445/7

See application file for complete search history.

(56) References Cited

U.S. PATENT DOCUMENTS

| | | | | |
|---|---|---|---|---|
| 4,109,633 | A | 8/1978 | Mitsudo et al. | |
| 4,331,899 | A | 5/1982 | Nishida et al. | |
| 4,983,877 | A * | 1/1991 | Kashiwara et al. | 313/140 |
| 5,373,214 | A * | 12/1994 | McCready | 313/142 |
| 5,998,912 | A * | 12/1999 | Schwab | 313/118 |
| 2006/0220511 | A1 | 10/2006 | Hanashi et al. | |

FOREIGN PATENT DOCUMENTS

| | | | |
|---|---|---|---|
| JP | 52-36238 | A | 3/1977 |
| JP | 55-121290 | A | 9/1980 |
| JP | 03226981 | A * | 10/1991 |
| JP | 2006-286469 | A | 10/2006 |
| RU | 2129327 | C1 * | 4/1999 |

OTHER PUBLICATIONS

Shin Nishioka, et al., "Super Ignition Spark Plug with Wear Resistive Electrode", Advanced Concepts, 2008, SAE Technical Paper Series.

* cited by examiner

*Primary Examiner* — Mariceli Santiago
(74) *Attorney, Agent, or Firm* — Sughrue Mion, PLLC

(57) ABSTRACT

There is provided a spark plug 100 with a ground electrode 30, wherein a protrusion amount A of a protruding portion 36 satisfies a relationship of 0.4 mm≦A≦1.0 mm and wherein a press recessed portion 37 extends to a front end surface 31 of the ground electrode 30.

8 Claims, 12 Drawing Sheets

[FIG. 1]
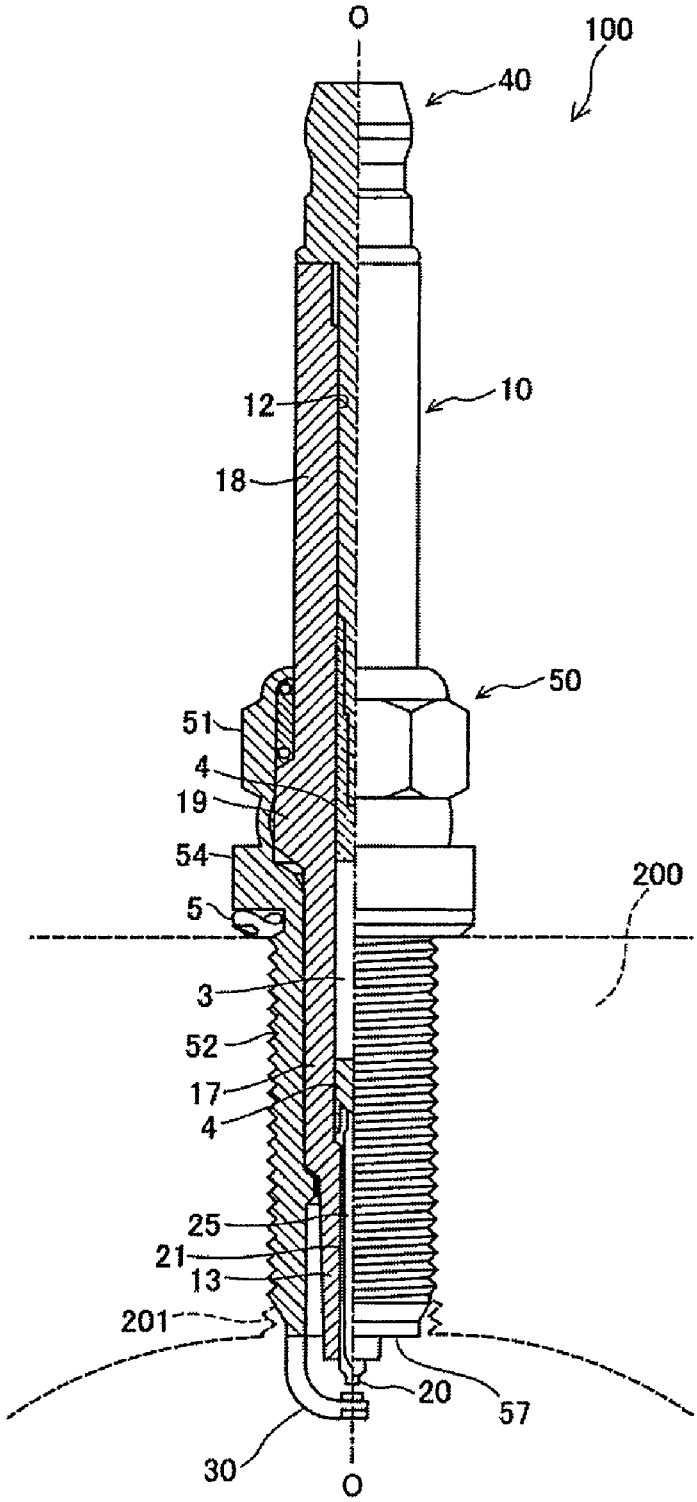

[FIG. 2]
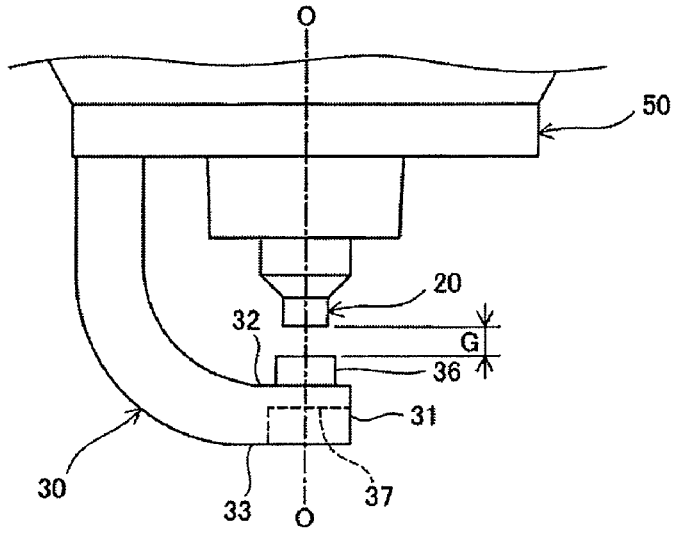
[FIG. 3]
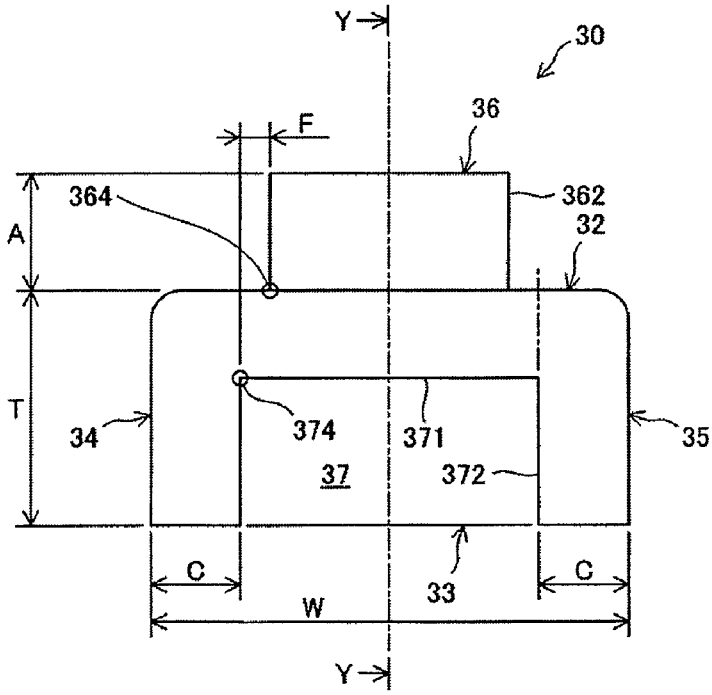

[FIG. 4]
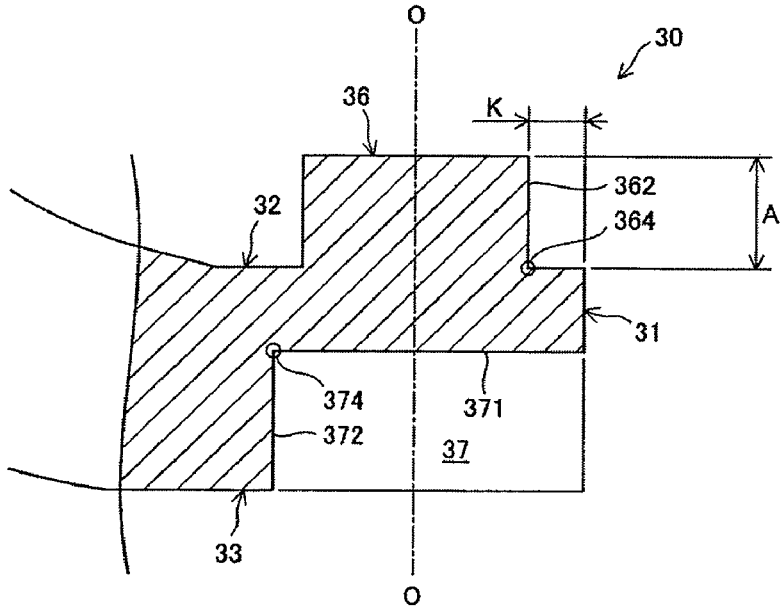
CROSS SECTION Y-Y
[FIG. 5]
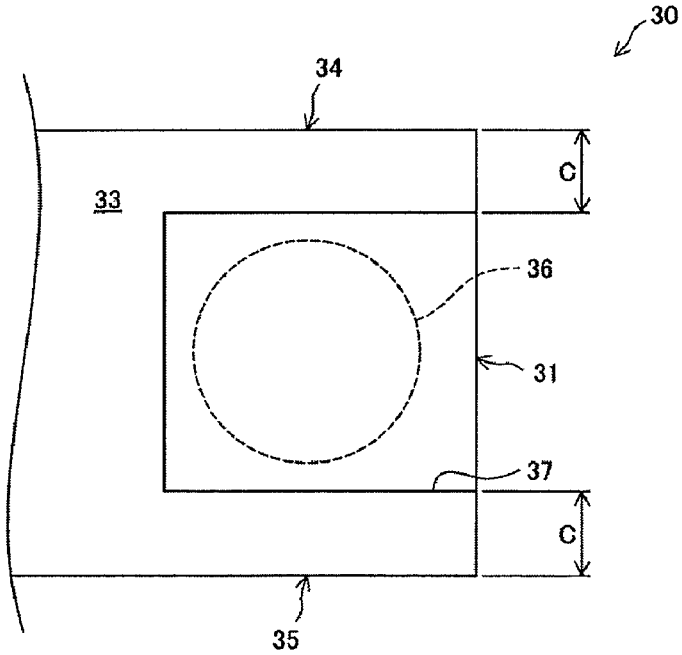

[FIG. 6]
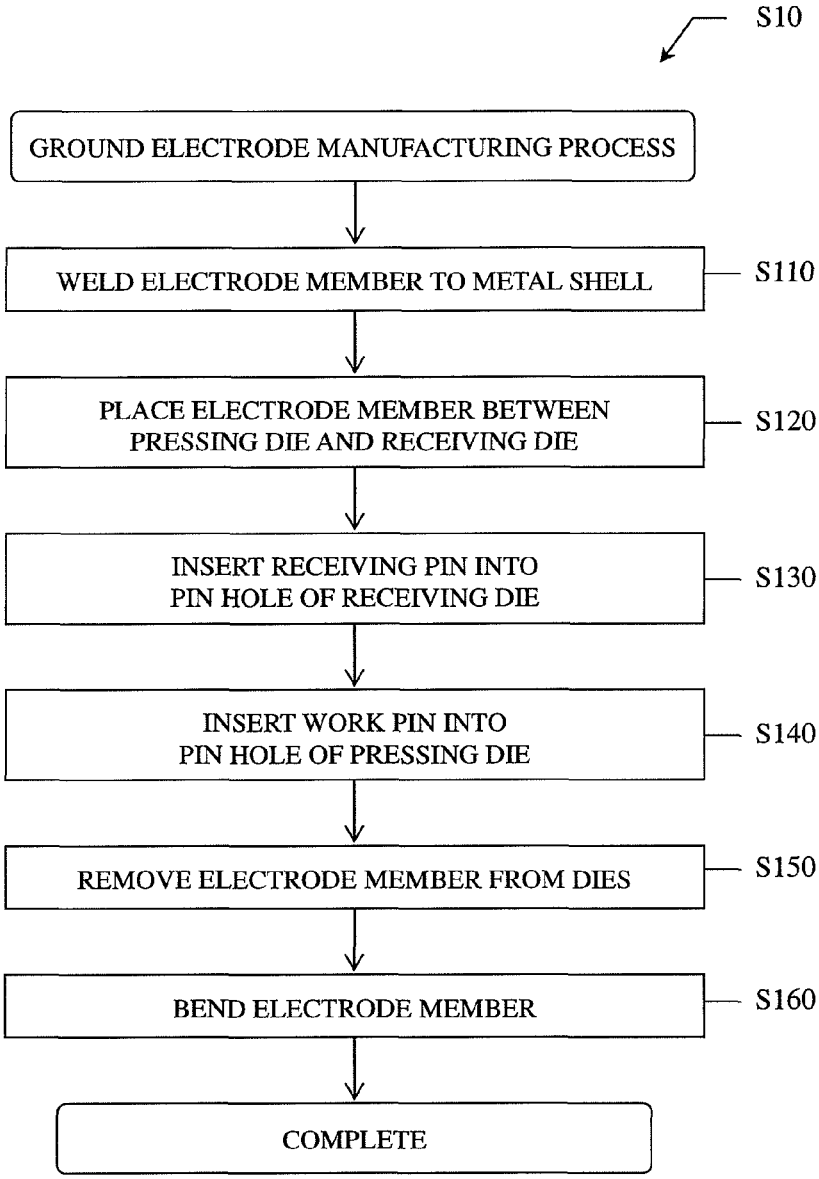

[FIG. 7]
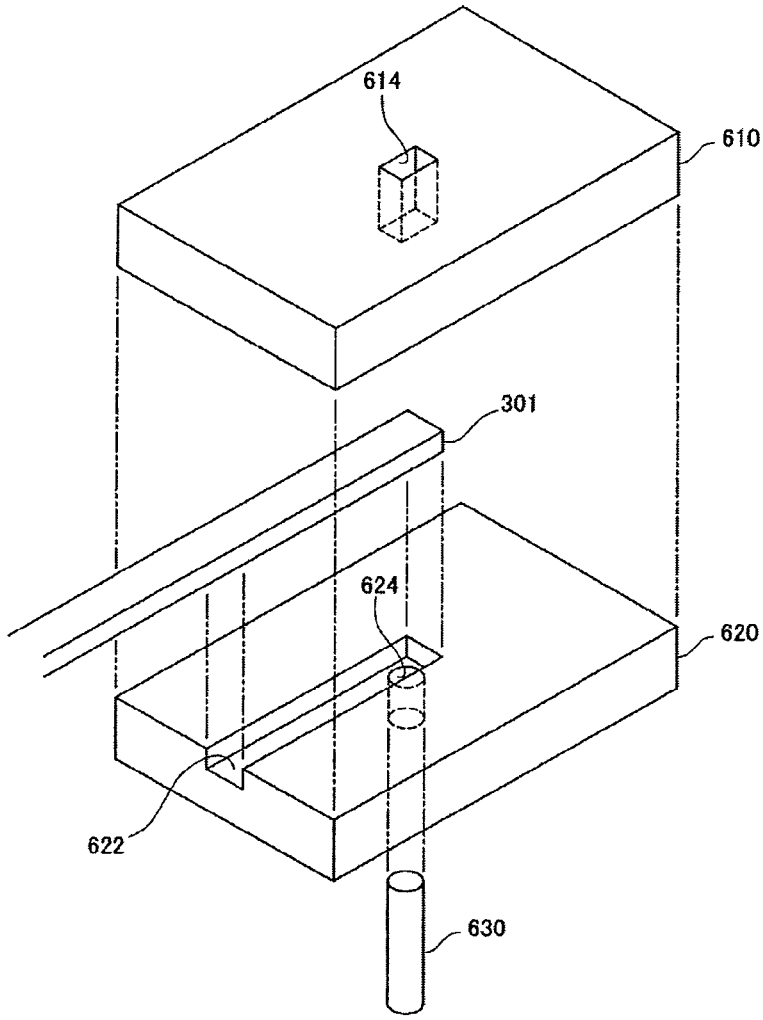
[FIG. 8]
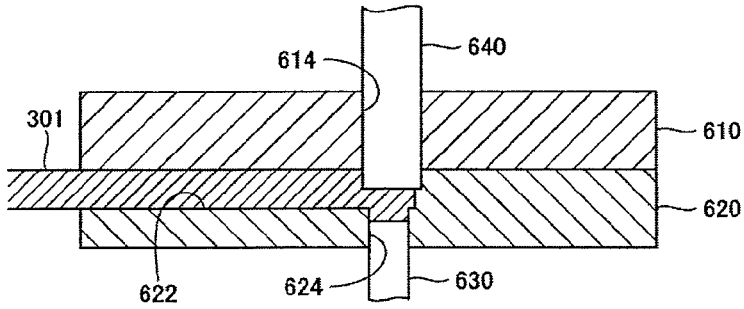

[FIG. 9]
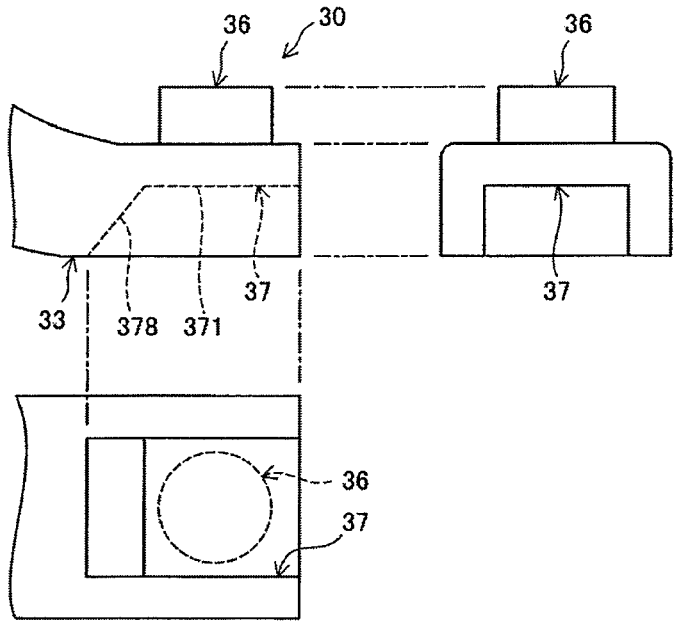
[FIG. 10]
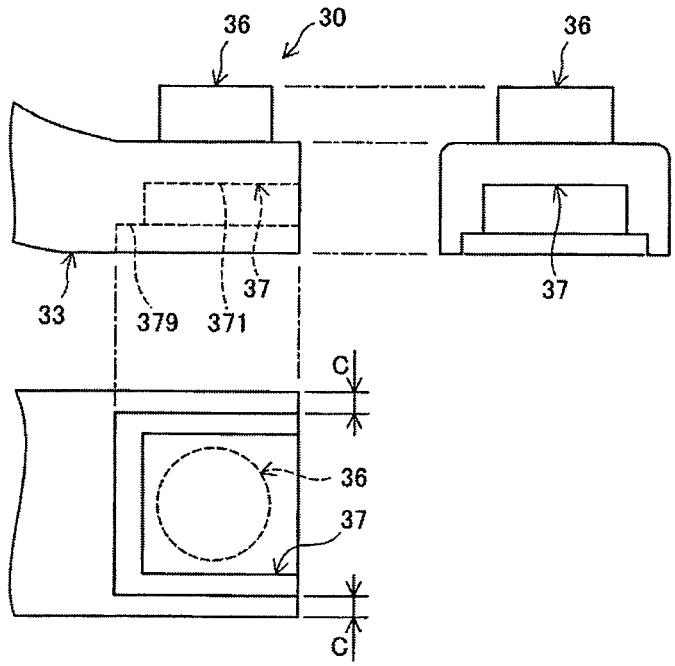

[FIG. 11]
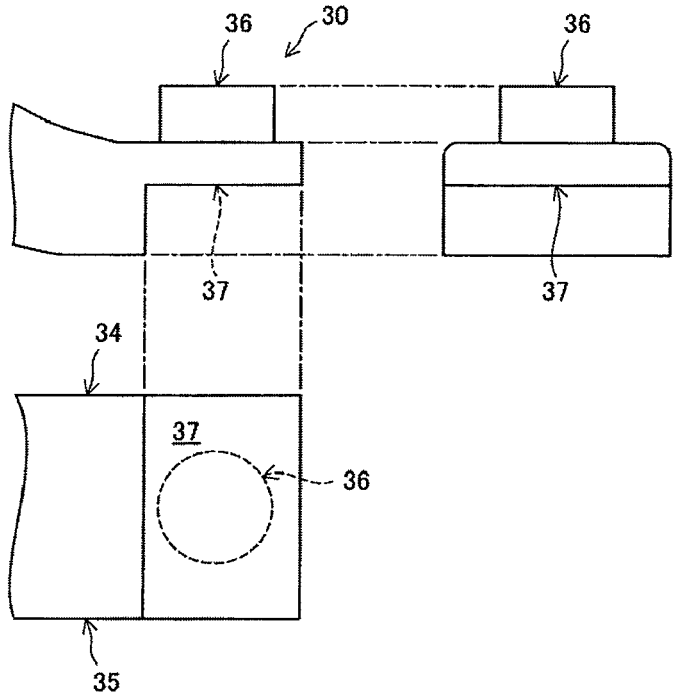
[FIG. 12A]
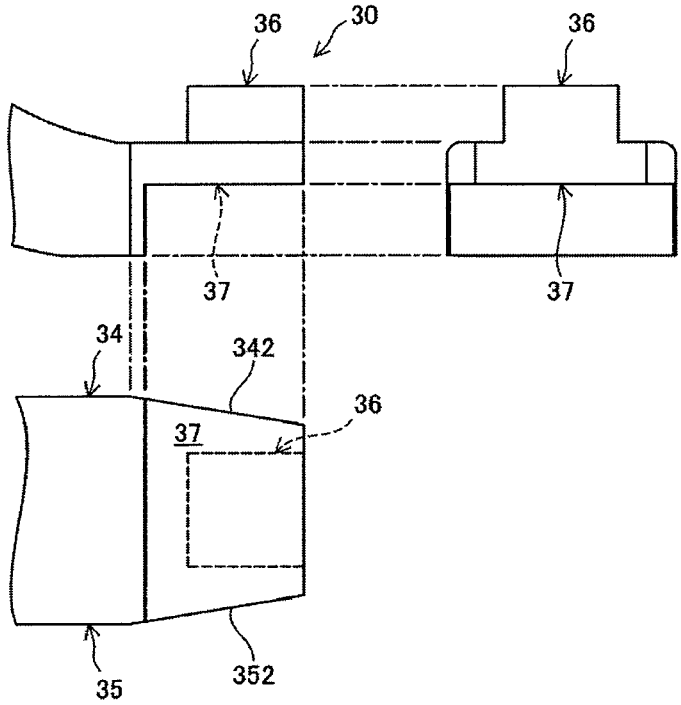

[FIG. 12B]
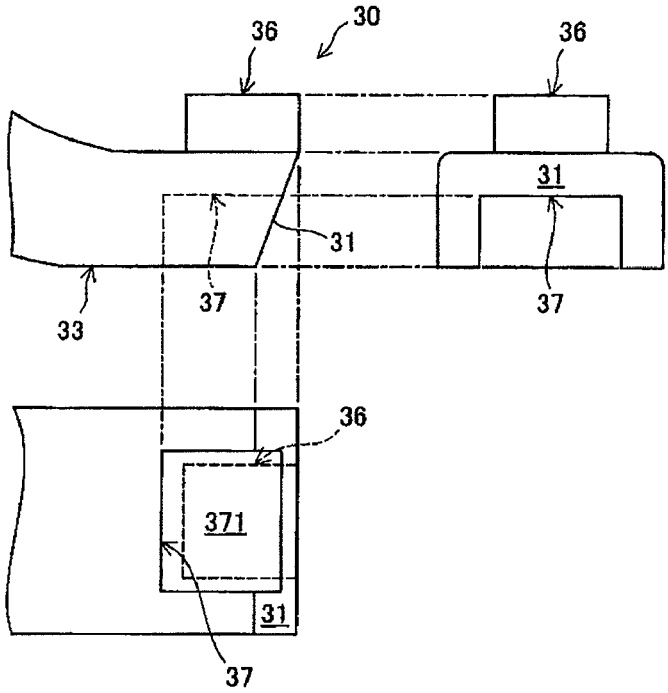
[FIG. 12C]
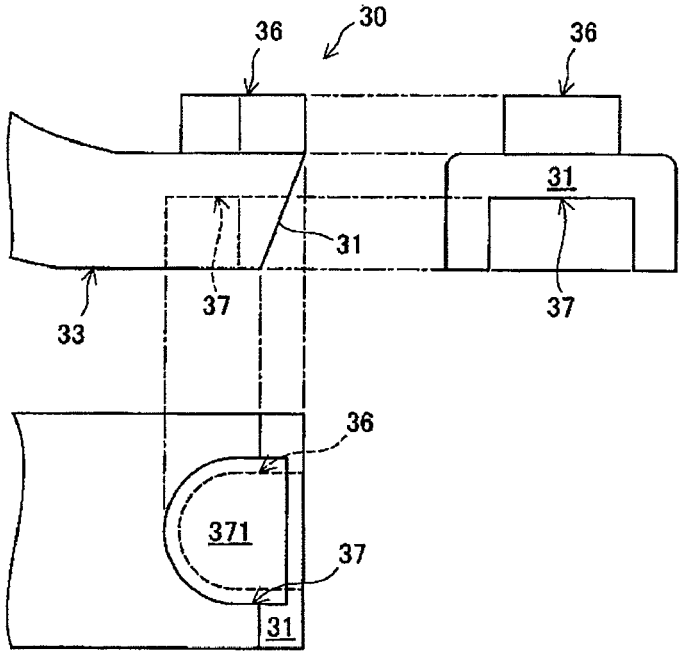

[FIG. 13]
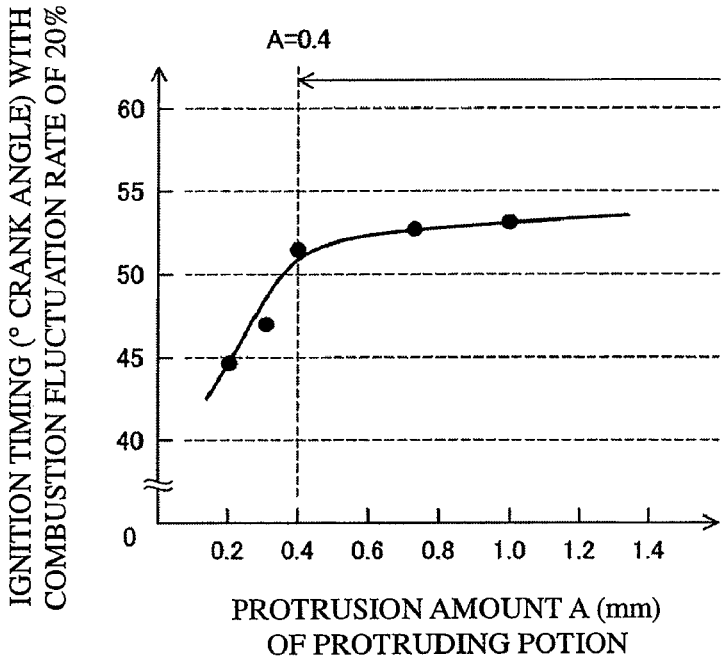
[FIG. 14]
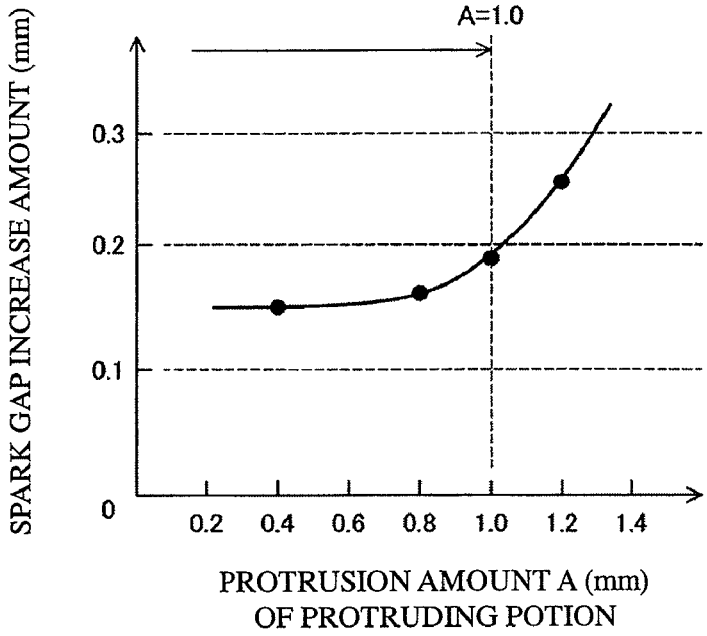

[FIG. 15]
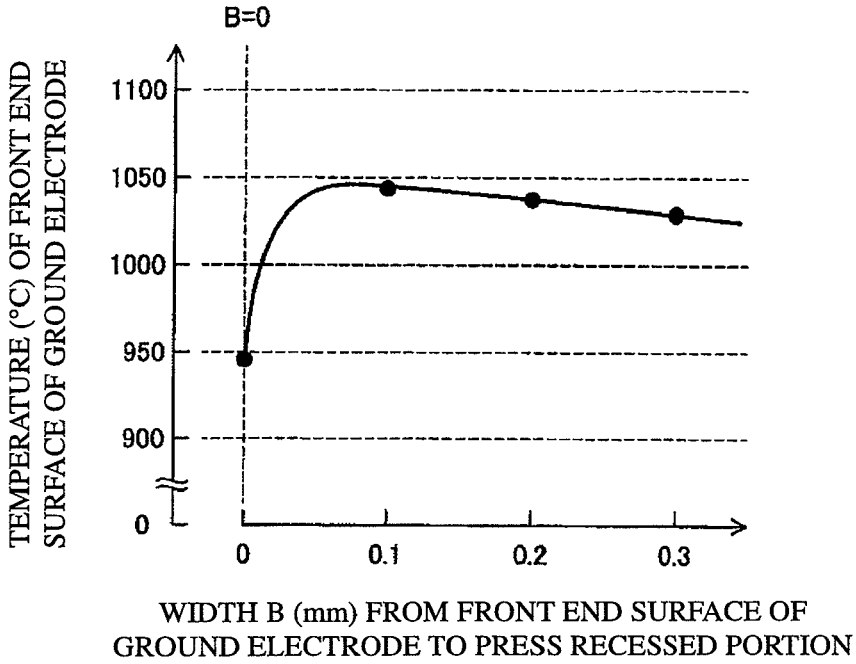
[FIG. 16]
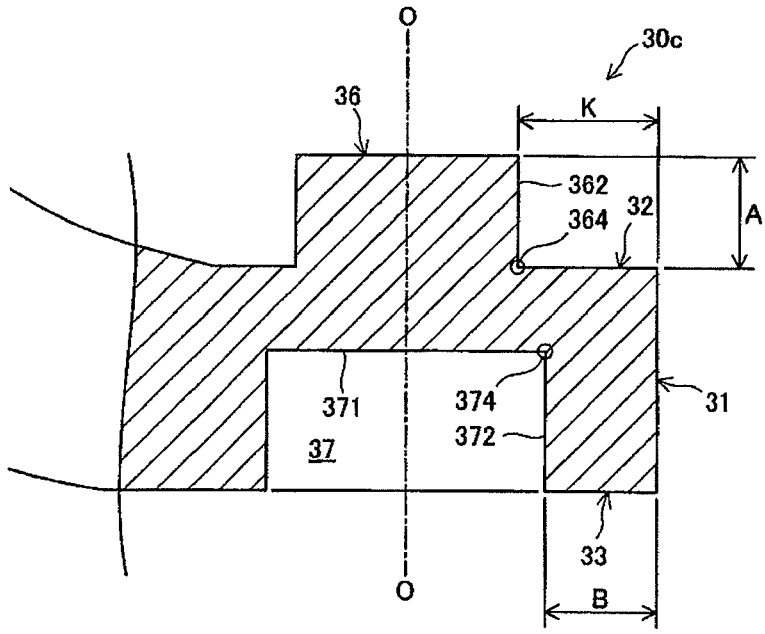
CROSS SECTION Y-Y

[FIG. 17]
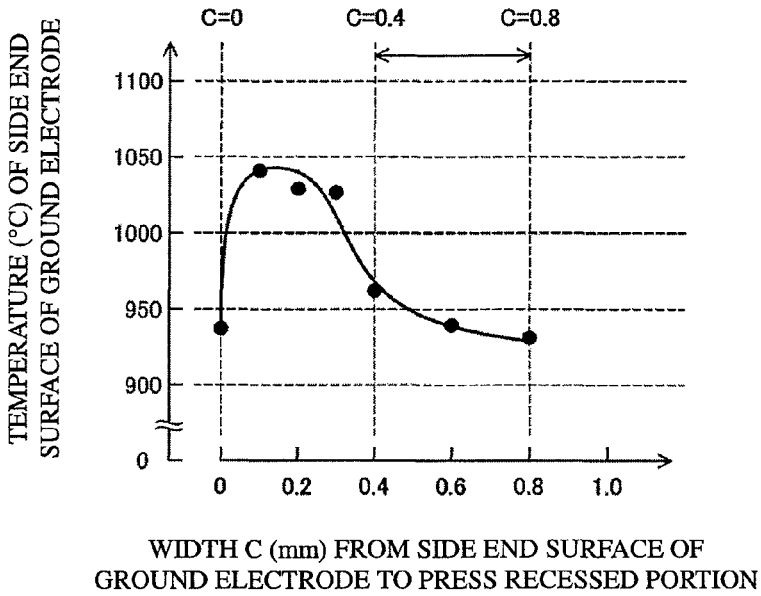
[FIG. 18]
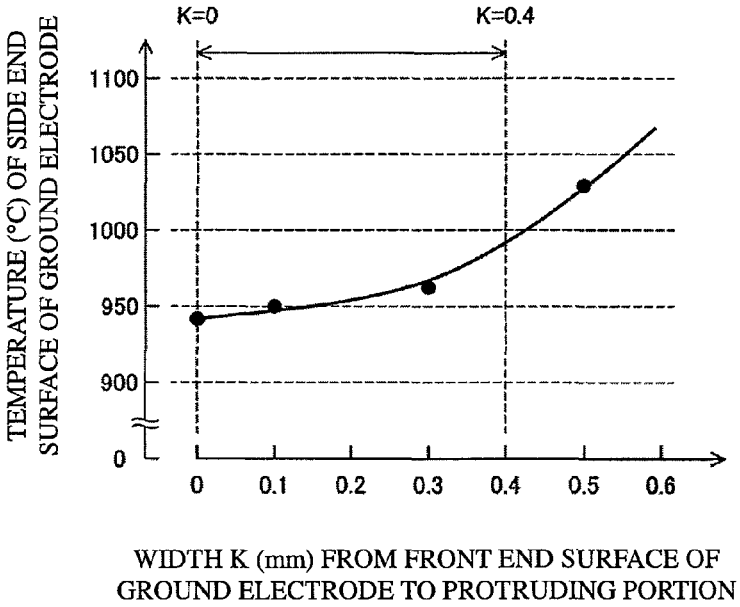

[FIG. 19]

| DISTANCE F (mm) OF LOCATION OF BOTTOM END REGION OF PROTRUDING PORTION INSIDE LATERAL SURFACE REGION OF PRESS RECESSED PORTION | −1.0 | −0.5 | −0.1 | 0 | 0.1 | 0.2 | 0.5 | 1.0 |
|---|---|---|---|---|---|---|---|---|
| CRACK OCCURRENCE RATE (%) | 100 | 100 | 90 | 0 | 0 | 0 | 0 | 0 |

SPARK PLUG AND MANUFACTURING METHOD THEREOF

CROSS REFERENCE TO RELATED APPLICATIONS

This application is a National Stage of International Application No. PCT/JP2009/005285 filed Oct. 9, 2009, claiming priority based on Japanese Patent Application No. 2008-267452, filed Oct. 16, 2008, the contents of all of which are incorporated herein by reference in their entirety.

TECHNICAL FIELD

The present invention relates to a spark plug (ignition plug) for generating a spark electrically to ignite fuel in an internal combustion engine and, more specifically, to a ground electrode of the spark plug.

BACKGROUND ART

In order to improve the ignition performance of a spark plug without providing a noble metal tip to a ground electrode of the spark plug, it has previously been proposed to form a protruding portion by press working on the ground electrode. Patent Document 1 discloses a technique to form a protruding portion on a ground electrode by one press working process called "forge pressing". Non-Patent Document 1 discloses a technique to form a protruding portion on a ground electrode by another press working process called "extrusion pressing".

PRIOR ART DOCUMENTS

Patent Document

Patent Document 1: Japanese Laid-Open Patent Publication No. 2006-286469

Non-Patent Document

Non-Patent Document 1: Shin Nishioka et al., "Super Ignition Spark Plug with Wear Resistive Electrode", SAE TECHNICAL PAPER SERIES 2008-01-0092, issued on April, 2008

The formation of such a protruding portion on the ground electrode by press working has not, however, been sufficiently considered. For example, there is a problem that the durability of the ground electrode deteriorates as the ground electrode gets deformed beyond its plastic region and thereby becomes cracked or broken by press working. Under the circumstance that the shape of the ground electrode formable by press working is limited, there is also a problem that the durability of the ground electrode deteriorates as the ground electrode becomes oxidized due to excessive heat accumulation in the internal combustion engine depending on the shape of the ground electrode.

DISCLOSURE OF THE INVENTION

Problems to be Solved by the Invention

In view of the above problems, it is an object of the present invention to provide a technique for improving the durability of a spark plug with a press-worked ground electrode.

Means for Solving the Problems

The present invention has been made to solve at least part of the above problems and can be realized as the following embodiments or application examples.

Application Example 1

According to Application Example 1, there is provided a spark plug that includes: a shaft-shaped center electrode; a ceramic insulator holding an outer circumference of the center electrode; a metal shell holding an outer circumference of the ceramic insulator; and a ground electrode joined to the metal shall so as to define a spark gap between the center electrode and the ground electrode, the ground electrode having an opposing surface facing a front end of the center electrode, a back surface located opposite from the front end of the center electrode, a protruding portion formed on the opposing surface by extrusion pressing and protruding from the opposing surface toward the front end of the center electrode and a press recessed portion made in the back surface due to the formation of the protruding portion by extrusion pressing and recessed from the back surface toward the front end of the center electrode, wherein a protrusion amount A of the protruding portion from the opposing surface satisfies a relationship of $0.4\ \text{mm} \leqq A \leqq 1.0\ \text{mm}$; and wherein the press recessed portion reaches a front end of the ground electrode. In the spark plug of Application Example 1, the thermal radiation characteristics of the front end of the ground electrode can be increased effectively. It is thus possible to improve the durability of the spark plug with the press-worked ground electrode.

Application Example 2

The spark plug of Application Example 1 is preferably characterized in that a width C from a side end of the ground electrode to the press recessed portion satisfies a relationship of $0.4\ \text{mm} \leqq C \leqq 0.8\ \text{mm}$. In the spark plug of Application Example 2, not only the thermal radiation characteristics of the front end of the ground electrode but also the thermal radiation characteristics of the side end of the ground electrode can be increased effectively. It is thus possible to further improve the durability of the spark plug with the press-worked ground electrode.

Application Example 3

The spark plug of Application Example 1 is preferably characterized in that the press recessed portion extends to both of the front end and the side end of the ground electrode. In the spark plug of Application Example 3, not only the thermal radiation characteristics of the front end of the ground electrode but also the thermal radiation characteristics of the side end of the ground electrode can be increased effectively. It is thus possible to further improve the durability of the spark plug with the press-worked ground electrode.

Application Example 4

The spark plug of any one of Application Examples 1 to 3 is preferably characterized in that a width K from the front end of the ground electrode to the protruding portion satisfies a relationship of $0\ \text{mm} \leqq K \leqq 0.4\ \text{mm}$. In the spark plug of Application Example 4, the thermal radiation characteristics of the front end of the ground electrode can be further increased.

Application Example 5

The spark plug of any one of Application Examples 1 to 4 is preferably characterized in that the protruding portion is located inside the press recessed portion when viewed from a direction in which the protruding portion faces the center electrode. In the spark plug of Application Example 5, the occurrence of a crack in the protruding portion and periphery thereof can be prevented as the position of the protruding portion is displaced from a direction of shear force radially exerted from a bottom corner region of the press recessed portion at the time of extrusion molding of the ground electrode. It is thus possible to further improve the durability of the spark plug with the press-worked ground electrode.

Application Example 6

According to Application Example 6, there is provided a manufacturing method of a spark plug, the spark plug including a shaft-shaped center electrode, a ceramic insulator holding an outer circumference of the center electrode, a metal shell holding an outer circumference of the ceramic insulator and a ground electrode joined to the metal shell so as to define a spark gap between the center electrode and the ground electrode, the manufacturing method comprising: forming a protruding portion by extrusion pressing on an opposing surface of the ground electrode facing a front end of the center electrode in such a manner that the protruding portion protrudes from the opposing surface toward the front end of the center electrode and that a protrusion amount A of the protruding portion from the opposing surface satisfies a relationship of 0.4 mm≦A≦1.0 mm; and forming a press recessed portion in a back surface of the ground electrode located opposite from the front end of the center electrode in such a manner that the press recessed portion is recessed from the back surface toward the front end of the center electrode and extends to a front end of the ground electrode. It is possible by the spark plug manufacturing method of Application Example 6 to form the ground electrode with excellent thermal radiation characteristics while preventing the occurrence of a crack or break in the ground electrode by press working.

Herein, the embodiments of the present invention are not limited to a spark plug and a manufacturing method thereof. The present invention can be embodied in various forms such as a ground electrode for a spark plug, a manufacturing method of a ground electrode and an internal combustion engine with a ground electrode. Further, the present invention is not limited to the above embodiments and can be modified in various manners without departing from the scope of the present invention.

BRIEF DESCRIPTION OF DRAWINGS

FIG. 1 is a schematic diagram, partially in cross section, of a spark plug according to one embodiment of the present invention.

FIG. 2 is a schematic diagram showing a detailed structure of a ground electrode of the spark plug according to the above one embodiment of the present invention.

FIG. 3 is an enlarged view of part of the ground electrode as viewed from a front end surface side thereof according to the above one embodiment of the present invention.

FIG. 4 is an enlarged cross section view of part of the ground electrode taken along line Y-Y of FIG. 3.

FIG. 5 is an enlarged view of part of the ground electrode as viewed from a back surface side thereof according to the above one embodiment of the present invention.

FIG. 6 is a flowchart of a manufacturing method of the ground electrode according to the above one embodiment of the present invention.

FIG. 7 is a schematic diagram showing a state of manufacturing of a ground electrode 30.

FIG. 8 is a schematic diagram showing a state of manufacturing of the ground electrode 30.

FIG. 9 is a diagram showing three orthographic views of the ground electrode according to a first modification of the above one embodiment of the present invention.

FIG. 10 is a diagram showing three orthographic views of the ground electrode according to a second modification of the above one embodiment of the present invention.

FIG. 11 is a diagram showing three orthographic views of the ground electrode according to a third modification of the above one embodiment of the present invention.

FIG. 12A is a diagram showing three orthographic views of the ground electrode according to a fourth modification of the above one embodiment of the present invention.

FIG. 12B is a diagram showing three orthographic views of the ground electrode according to a fifth modification of the above one embodiment of the present invention.

FIG. 12C is a diagram showing three orthographic views of the ground electrode according to a sixth modification of the above one embodiment of the present invention.

FIG. 13 is a diagram showing the results of an evaluation test to examine the influence of a protrusion amount A on ignition performance.

FIG. 14 is a diagram showing the results of an evaluation test to examine the influence of a protrusion amount A on durability performance.

FIG. 15 is a diagram showing the results of an evaluation test to examine the influence of the positional relationship of a press recessed portion and a front end surface of the ground electrode on durability performance.

FIG. 16 is a schematic diagram of a ground electrode according to Comparative Example.

FIG. 17 is a diagram showing the results of an evaluation test to examine the influence of a width C on durability performance.

FIG. 18 is a diagram showing the results of an evaluation test to examine the influence of a width K on durability performance.

FIG. 19 is a diagram showing the results of an evaluation test to examine the influence of a width K on moldability.

BEST MODES FOR CARRYING OUT THE INVENTION

A spark plug in which the present invention is embodied will be described in detail below in order to clarify the constitution and effects of the present invention more clearly.

A. Embodiment

A-1. Structure of Spark Plug

FIG. 1 is a schematic diagram, partially in cross section, of a spark plug 100 according to one embodiment of the present invention. The spark plug 100 includes a ceramic insulator 10, a center electrode 20, a ground electrode 30, a metal terminal fitting 40 and a metal shell 50. The center electrode 20 is shaft-shaped and placed in one end of the ceramic insulator 10 in such a manner as to protrude from the one end of the ceramic insulator 10. The metal terminal fitting 40 is placed in the other end of the ceramic insulator 10. The center electrode 20 and the metal terminal fitting 40 are electrically connected to each other through the inside of the ceramic insulator 10, with the outer circumference of the center electrode 20 insulated by the ceramic insulator 10. The outer circumference of the ceramic insulator 10 is held by the metal shell 50 at a position apart from the metal terminal fitting 40. The ground electrode 30 is electrically connected to the metal shell 50 and arranged to define a spark gap G in which a spark occurs between the ground electrode 30 and a front end of the center electrode 20. The spark plug 100 is mounted in a threaded mounting hole 201 of an engine head 200 of an internal combustion engine (not shown) via the metal shell 50. When a high voltage of 20000 to 30000 volts is applied to the metal terminal fitting 40, there occurs a spark in the spark gap G between the center electrode 20 and the ground electrode 30.

The ceramic insulator 10 of the spark plug 100 is an insulator made by sintering a ceramic material such as alumina. The ceramic insulator 10 has a cylindrical shape with an axial hole 12 formed in a center thereof so as to accommodate therein the center electrode 20 and the metal terminal fitting 40. The ceramic insulator 10 includes a flange portion 19 formed at an axially middle position thereof with an increased diameter. The ceramic insulator 10 also includes a rear body portion 18 formed at a position closer to the metal terminal fitting 40 than the flange portion 19 so as to provide insulation between the metal terminal fitting 40 and the metal shell 50. The ceramic insulator 10 further includes a front body portion 17 formed at a position closer to the center electrode 20 than the flange portion 19 and made smaller in outer diameter than the rear body portion 18 and a leg portion 13 formed at a position closer to a front end thereof than the front body portion 17 and made smaller in outer diameter than the front body portion 17 in such a manner that the outer diameter of the leg portion 13 gradually decreases toward the center electrode 20.

The metal shell 50 of the spark plug 100 is a cylindrical metal fitting adapted to surround and hold therein a part of the ceramic insulator 10 from some region of the rear body portion 18 to the leg portion 13. In the present embodiment, the metal shell 50 is made of low carbon steel. The metal shell 50 includes a tool engagement portion 51, a mounting thread portion 52, a seal portion 54 and a front end face 57. The tool engagement portion 51 of the metal shell 50 is adapted to engage with a tool (not shown) for mounting the spark plug 100 to the engine head 200. The mounting thread portion 52 of the metal shell 50 has a thread screwed into the threaded mounting hole 201 of the engine head 200. The seal portion 54 of the metal shell 50 is formed into a flange shape at a bottom of the mounting thread portion 52. An annular gasket 5 formed by bending a plate material is inserted between the seal portion 54 and the engine head 200. The front end face 57 of the metal shell 50 is formed into a hollow circular shape at a front end of the mounting thread portion 52 so that the center electrode 20, covered with the leg portion 13, protrudes through a center of the front end face 57.

The center electrode 20 of the spark plug 100 is an electrode made by embedding, in a bottomed cylindrical electrode body 21, a core 25 of higher thermal conductivity than the electrode body 21. In the present embodiment, the electrode body 21 is made of a nickel alloy containing nickel as a main component, such as Inconel (trademark); and the core 25 is made of copper or an alloy containing copper as a main component. The center electrode 20 is inserted in the axial hole 12 of the ceramic insulator 10, with a front end of the electrode body 21 protruding from the axial hole 12 of the ceramic insulator 10, and is electrically connected to the metal terminal fitting 40 via a ceramic resistor 3 and seal members 4.

The ground electrode 30 of the spark plug 100 is an electrode joined to the front end face 57 of the metal shell 50 and bent in a direction that intersects an axial direction of the center electrode 20 so as to face a front end of the center electrode 20. In the present embodiment, the ground electrode 30 is made of a nickel alloy containing nickel as a main component, such as Inconel (trademark).

FIG. 2 is a schematic diagram showing a detailed structure of the ground electrode 30. The ground electrode 30 has a front end surface 31 that constitutes a front end of the ground electrode 30, an opposing surface 32 defined as a surface of the ground electrode 30 facing the center electrode 20 and a back surface 33 defined as a surface of the ground electrode 30 located in the back of the opposing surface 32 and opposite from the front end of the center electrode 20. The ground electrode 30 also has a protruding portion 36 formed by extrusion pressing on the opposing surface 32 in such a manner that the protruding portion 36 faces and protrudes toward the front end of the center electrode 20. The spark gap G is thus defined between the protruding portion 36 and the center electrode 20. The center of gravity of the protruding portion 36 is substantially located on an extension of the center axis of the center electrode 20. Further, the ground electrode 30 has a press recessed portion 37 made in the back surface 33 at a position back of the protruding portion 36 due to the formation of the protruding portion 36 by extrusion pressing. The press recessed portion 37 is recessed toward the front end of the center electrode 20 and extends to and reaches the front end surface 31. In the present embodiment, the protruding portion 36 is a cylindrical protrusion circular in cross section; and the press recessed portion 37 is a rectangle recess rectangular in cross section.

FIG. 3 is an enlarged view of part of the ground electrode 30 as viewed from the side of the front end surface 31. FIG. 4 is an enlarged cross section view of part of the ground electrode 30 taken along line Y-Y of FIG. 3. FIG. 5 is an enlarged view of part of the ground electrode 30 as viewed from the side of the back surface 33. The cross section Y-Y of the ground electrode 30 is defined as passing through the center axis of the center electrode 20 substantially along the direction in which the ground electrode 30 protrudes from the metal shell 50 toward the center electrode 20.

The ground electrode 30 has side end surfaces 34 and 35 in addition to the front end surface 31, the opposing surface 32 and the back surface 33. The side end surface 34, 35 of the ground electrode 30 intersects each of the front end surface 31, the opposing surface 32 and the back surface 33 and constitutes a side end of the ground electrode 30. In the present embodiment, a distance between the opposing surface 32 and the back surface 33, i.e., a thickness T of the ground electrode 30 is set to 1.5 mm; and a distance between the side end surfaces 34 and 35, i.e., a width W of the ground electrode 30 is set to 2.8 mm.

As shown in FIGS. 3 and 4, the protruding portion 36 of the ground electrode 30 includes a lateral surface region 362 and a bottom end region 364. The lateral surface region 362 of the protruding portion 36 extends substantially along the direction in which the protruding portion 36 protrudes from the opposing surface 32, i.e., the direction toward the center electrode 20. The bottom end region 364 of the protruding portion 36 rises from the opposing surface 32 and continues to the lateral surface region 362. In the present embodiment, the lateral surface region 362 of the protruding portion 36 is formed substantially perpendicular to the opposing surface 32; and the bottom end region 364 of the protruding portion 36 is formed into a substantially right-angle corner. It is preferable that a protrusion amount A of the protruding portion 36 from the opposing surface 32 satisfies a relationship of 0.4 mm≦A≦1.0 mm. It is also preferable that a width K from the lateral surface region 362 of the protruding portion 36 to the front end surface 31 of the ground electrode 30 satisfies a relationship of 0 mm≦K≦0.4 mm. The evaluation values of the protrusion amount A and the width K will be discussed later in detail.

Further, the press recessed portion 37 of the ground electrode 30 includes a bottom surface region 371, a lateral surface region 372 and a corner region 374 as shown in FIGS. 3 and 4. The bottom surface region 371 of the press recessed portion 37 extends to the front end surface 31 substantially in parallel with the back surface 33 and constitutes a bottom of the press recessed portion 37. The positional relationship of the press recessed portion 37 and the front end surface 31 will be discussed later in detail.

The lateral surface region 372 of the press recessed 37 extends substantially along the direction in which the press recessed portion 37 is recessed from the back surface 33 toward the opposing surface 32, i.e., the direction toward the center electrode 20. The corner region 374 of the press recessed portion 37 extends from the bottom surface region 371 to the lateral surface region 372. In the present embodiment, the lateral surface region 372 of the press recessed portion 37 is formed substantially perpendicular to the bottom surface region 371 of the press recessed portion 37 and to the back surface 33 of the ground electrode 30; and the corner region 374 of the press recessed portion 37 is formed into a substantially right-angle corner. It is preferable that a width C between the lateral surface region 372 of the press recessed portion 37 and the side end surface 34, 35 of the ground electrode 30 satisfies a relationship of C=0 (i.e., the press recessed portion 37 extends to and reaches the side end surface 34, 35) or a relationship of 0.4 mm≦C≦0.8 mm. The evaluation value of the width C will be discussed later in detail.

As shown in FIG. 5, the protruding portion 36 is preferably located inside the press recessed portion 37 when the ground electrode 30 is viewed from the side of the back surface 33, i.e., when viewed in the direction in which the protruding portion 36 faces the center electrode 20. Namely, it is preferable that a distance F by which the bottom end region 364 of the protruding portion 36 is located inside the lateral surface region 372 of the press recessed portion 37 is greater than or equal to 0 mm as shown in FIG. 3. The evaluation value of the distance F will also be discussed later in detail.

A-2. Manufacturing Method of Spark Plug

A manufacturing method of the ground electrode 30, which is a part of a manufacturing method of the spark plug 100, will be next described below. FIG. 6 is a flowchart of the manufacturing method of the ground electrode 30. FIGS. 7 and 8 are schematic diagrams showing states of manufacturing of the ground electrode 30. For manufacturing of the ground electrode 30, an electrode member 301 is prepared as a material of the ground electrode 30 and welded to the metal shell 50 (Step S110). In the present embodiment, the electrode member 301 is a substantially rectangular cross-section rod material of nickel alloy.

After welding the electrode member 301 to the metal shell 50 (Step S110), the electrode member 301 is placed in position between a pressing die 610 and a receiving die 620 (Step S120). The pressing die 610 and the receiving die 620 are a die assembly for extrusion pressing. As shown in FIG. 7, the receiving die 620 has a molding groove 622 formed into substantially the same shape as that of the electrode member 301 so that the electrode member 301 is fitted in the molding groove 622 of the receiving die 620. The pressing die 610 has a pin hole 614 formed in alignment with the molding groove 622 of the receiving die 620 so as to correspond in position to the press recessed portion 37 of the ground electrode 30. Further, the receiving die 620 has a pin hole 624 formed so as to correspond in position to the protruding portion 36 of the ground electrode 30.

After placing the electrode member 301 in position between the pressing die 610 and the receiving die 620 (Step S120), a receiving pin 630 is inserted in the pin hole 624 of the receiving die 620 (Step S130). The receiving pin 630 is substantially the same in diameter as the pin hole 624 of the receiving die 620 and is used to adjust the protrusion amount A of the protruding portion 36 according to the amount of insertion of the receiving pin 630 in the pin hole 624.

After inserting the receiving pin 630 in the pin hole 624 (Step S130), a work pin 640 is press-inserted in the pin hole 614 of the pressing die 610, thereby subjecting the electrode member 301 to extrusion pressing (Step S140). As shown in FIG. 8, upon press-insertion of the work pin 640 in the pin hole 614, a part of the electrode member 301 adjacent to the pin hole 614 of the pressing die 610 is pressed and recessed by the work pin 640 to define the pressed portion recess 37; and a part of the electrode member 301 adjacent to the pin hole 624 of the receiving die 620 is extruded by the work pin 640 to define the protruding portion 36.

After extrusion pressing the electrode member 301 (Step S140), the electrode member 301 with the protruding portion 36 and the press recessed portion 37 is removed from the dies (Step S150). Subsequently, the electrode member 301 removed from the dies is bent (Step S160). With this, the ground electrode 30 is completed. Although the ground electrode 30 is manufactured by subjecting the electrode member 301, which has previously been welded to the metal shell 50, to extrusion pressing and bending in the present embodiment, it is conceivable according to another embodiment to manufacture the ground electrode 30 by subjecting the electrode member 301 to extrusion pressing and bending before welding the electrode member 301 to the metal shell 50, or by subjecting the electrode member 301 to extrusion pressing and, after welding the electrode member 301 to the metal shell 50, subjecting the electrode member 301 to bending.

A-3. Modifications

FIG. 9 is a diagram showing three orthographic views of the ground electrode 30 according to a first modification of the above embodiment. In FIG. 9, the three orthographic views of the ground electrode 30 according to the first modification as viewed from the side of the side end surface 34, from the side of the front end surface 31 and from the side of the back surface 33 are shown. The ground electrode 30 of the first modification is similar to that of the above embodiment, except that the press recessed portion 37 has an inclined region 378 inclined in such a manner that the opening of the press recessed portion 37 becomes wider toward the back surface 33.

FIG. 10 is a diagram showing three orthographic views of the ground electrode 30 according to a second modification of the above embodiment. In FIG. 10, the three orthographic views of the ground electrode 30 according to the second modification as viewed from the side of the side end surface 34, from the side of the front end surface 31 and from the side of the back surface 33 are shown. The ground electrode 30 of the second modification is similar to that of the above embodiment, except that the press recessed portion 37 has a widened region 379 widened at a location adjacent to the back surface 33. In this case, the widened region 379 has a rectangular cross section larger in size than the rectangular profile of the bottom surface region 371. Further, it is preferable that a width C from the widened region 379 to the side end surface 34, 35 of the ground electrode 30 satisfies a relationship of 0.4 mm≦C≦0.8 mm.

FIG. 11 is a diagram showing three orthographic views of the ground electrode 30 according to a third modification of the above embodiment. In FIG. 11, the three orthographic views of the ground electrode 30 according to the third modification as viewed from the side of the side end surface 34, from the side of the front end surface 31 and from the side of the back surface 33 are shown. The ground electrode 30 of the third modification is similar to that of the above embodiment, except that the press recessed portion 37 extends to and reaches both of the front end surface 31 and the side end surfaces 34 and 35. The positional relationship of the press recessed portion 37 and the front end surface 31 and the positional relationship of the press recessed portion 37 and the side end surface 34, 35 will be discussed later in detail.

FIG. 12A is a diagram showing three orthographic views of the ground electrode 30 according to a fourth modification of the above embodiment. In FIG. 12A, the three orthographic views of the ground electrode 30 according to the fourth modification as viewed from the side of the side end surface 34, from the side of the front end surface 31 and from the side of the back surface 33 are shown. The ground electrode 30 of the fourth modification is similar to that of the above embodiment, except that the side end surfaces 34 and 35 have gradually narrowing regions 342 and 352 formed in such a manner as to decrease the width of the ground electrode 30 gradually toward the front end surface 31, that the press recessed portion 37 extends to and reaches both of the front end surface 31 and the side end surfaces 34 and 35 as in the case of the third modification, and that the protruding portion 36 is rectangular in shape when the ground electrode 30 is viewed from the side of the back surface 33.

FIG. 12B is a diagram showing three orthographic views of the ground electrode 30 according to a fifth modification of the above embodiment. In FIG. 12B, the three orthographic views of the ground electrode 30 according to the fifth modification as viewed from the side of the side end surface 34, from the side of the front end surface 31 and from the side of the back surface 33 are shown. The ground electrode 30 of the fifth modification is similar to that of the above embodiment, except that the front end surface 31 is inclined toward the press recessed portion 37 with respect to the back surface 33, that the protruding portion 36 is rectangular in shape when the ground electrode 30 is viewed from the side of the back surface 33, and that the lateral surface of the protruding portion 36 extends to and reaches the front end surface 31.

FIG. 12C is a diagram showing three orthographic views of the ground electrode 30 according to a sixth modification of the above embodiment. In FIG. 12C, the three orthographic views of the ground electrode 30 according to the sixth modification as viewed from the side of the side end surface 34, from the side of the front end surface 31 and from the side of the back surface 33 are shown. The ground electrode 30 of the sixth modification is similar to that of the fifth modification, except that when the ground electrode 30 is viewed from the side of the back surface 33, surfaces of the protruding portion 36 and of the press recessed portion 37 located opposite from the front end surface 31 are semicircular in shape.

A-4. Evaluation Value of Protrusion Amount A

FIG. 13 is a diagram showing the results of an evaluation test to examine the influence of the protrusion amount A on ignition performance. In FIG. 13, the test results are plotted with the protrusion amount A on the horizontal axis and the ignition timing with a combustion fluctuation rate of 20% on the vertical axis. The combustion fluctuation rate is herein obtained according to the following expression: Combustion Fluctuation Rate=(standard deviation/average value)×100 (%) on the basis of average value and standard deviation of 500 data samples by determining an Indicated Mean Effective Pressure (IMEP) from the combustion pressure. The ignition timing at which the combustion fluctuation rate reaches 20% is indicated in FIG. 13 in the unit of a crank angle of an internal combustion engine. For the evaluation test of FIG. 13, a plurality of test samples of the spark plug 100 were prepared. The diameter of the protruding portion 36 was set to 1.5 mm in each sample; and the protrusion amount A of the protruding portion 36 was varied from sample to sample. The test results of FIG. 13 were obtained by mounting each of these test samples of the spark plug 100 to a 2000 cc DOHC gasoline engine and idling the engine at an engine revolution speed of 750 rpm with an intake pressure of −550 mmHg. It has shown by the test results of FIG. 13 that the ignition performance decreases sharply when the protrusion amount A becomes less than 0.4 mm.

FIG. 14 is a diagram showing the results of an evaluation test to examine the influence of the protrusion amount A on durability performance. In FIG. 14, the test results are plotted with the protrusion amount A on the horizontal axis and the amount of increase of the spark gap G on the vertical axis. For the evaluation test of FIG. 14, a plurality of test samples of the spark plug 100 were prepared. The diameter of the protruding portion 36 was set to 1.5 mm in each sample; and the protrusion amount A of the protruding portion 36 was varied from sample to sample. The test results of FIG. 14 were obtained by mounting each of these samples of the spark plug 100 to a 2000 cc DOHC gasoline engine and driving the engine for 400 hours at an engine revolution speed of 5000 rpm under full throttle conditions, and then, measuring the amount of increase of the spark gap G. It has been shown by the test results of FIG. 14 that the amount of increase of the spark gap G sharply increases to an acceptable limit of 0.2 mm or higher when the protrusion amount A becomes greater than 1.0 mm.

It is thus preferable that the protrusion amount A is 0.4 mm or greater in view of the ignition performance as shown in FIG. 13 and is 1.0 mm or smaller in view of the durability as shown in FIG. 14. In other words, the protrusion amount A preferably satisfies 0.4 mm≦A≦1.0 mm.

A-5. Evaluation of Positional Relationship Between Press Recessed Portion 37 and Front End Surface 31.

FIG. 15 is a diagram showing the results of an evaluation test to examine the influence of the positional relationship of the press recessed portion 37 and the front end surface 31 on durability performance. FIG. 16 is a schematic view of a ground electrode 30*c* according to Comparative Example. In the ground electrode 30*c* of Comparative Example, the press recessed portion 37 was formed at a position apart from the front end surface 31; and there was some width B left between the lateral surface region 372 of the press recessed portion 37 and the front end surface 31. In FIG. 15, the test results are plotted with the width B on the horizontal axis and the temperature of the front end surface 31 on the vertical axis with the proviso that the width B of the ground electrode 30 according to the above embodiment in which the press recessed portion 37 extends to and reaches the front end surface 31 is 0. For the evaluation test of FIG. 15, a test sample of the spark plug 100 with the ground electrode 30 of the above one embodiment where the press recessed portion 37 extended to and reached the front end surface 31 and a plurality of test samples of the spark plug 100 with the ground electrode 30*c* where the width B from the press recessed portion 37 to the front end surface 31 was varied were prepared. In these test samples of the spark plug 100, the thickness T of the ground electrode 30, 30*c* was set to 1.5 mm; the electrode width W of the ground electrode 30, 30*c* was set to 2.8; the protrusion amount A of the protruding portion 36 was set to 0.7 mm; the diameter of the protruding portion 36 was set to 1.5 mm; the depth of the press recessed portion 37 was set to 0.7 mm; the width of the press recessed portion 37 was set to 1.7 mm; and the width C from the side end surface 34, 35 of the ground electrode 30 to the press recessed portion 37 was set to 0.5 mm. Each of the test samples of the spark plug 100 was subjected to 1000 cycles of heating with a burner at 950° C. for 2 minutes and cooling at room temperature for 1 minute. After that, the test results of FIG. 15 were obtained by measuring the temperature of a part of the front end surface 31 located closer to the bottom surface region 371 in the case of the ground electrode 30 and by measuring the temperature of a part of the front end surface 31 located closer to the back surface 33 in the case of the ground electrode 30*c*.

It has been shown by the test results of FIG. 15 that the temperature of the front end surface 31 sharply increases to an acceptable limit of 1000° C. or higher when the width B becomes greater than 0 mm. It is thus preferable that the press recessed portion 37 and the front end surface 31 satisfy such a positional relationship that the width B is 0 mm, i.e., the press recessed portion 37 extends to and reaches the front end surface 31.

A-6. Evaluation Value of Width C

FIG. 17 is a diagram showing the results of an evaluation test to examine the influence of the width C on durability performance. In FIG. 17, the test results are plotted with the width C on the horizontal axis and the temperature of the side end surface 34, 35 on the vertical axis with the proviso that the width C of the ground electrode 30 where the press recessed portion 37 extends to and reaches the side end surface 34, 35 is 0. For the evaluation test of FIG. 17, a plurality of test samples of the spark plug 100 were prepared. The width C from the side end surface 34, 35 of the ground electrode 30 to the press recessed portion 37 was varied from sample to sample. In each of the test samples of the spark plug 100, the thickness T of the ground electrode 30 was set to 1.5 mm; the electrode width W of the ground electrode 30 was set to 2.8 mm; the protrusion amount A of the protruding portion 36 was set to 0.7 mm; the depth of the press recessed portion 37 was set to 0.7 mm: the width of the press recessed portion 37 was set to (electrode width W−(2× width C)) mm; and the diameter of the protruding portion 36 was set to ((width of press recessed portion 37)−0.2) mm (1.7 mm at the maximum). The test results of FIG. 17 were obtained by subjecting these test samples of the spark plug 100 to 1000 cycles of heating with a burner at 950° C. for 2 minutes and cooling at room temperature for 1 minute, and then, measuring the temperature of a part of the side end surface 34, 35 of the ground electrode 30 located closer to the back surface 33 or the bottom surface region 371.

It has been shown by the test results of FIG. 17 that the temperature of the side end surface 34, 35 sharply increases to an acceptable limit of 1000° C. or higher when the width C becomes greater than 0 mm and smaller than 0.4 mm. Further, it was impossible to work the ground electrode 30 favorably by extrusion pressing when the width C was greater than 0.8 mm. It is thus preferable that the width C satisfies C=0 mm (i.e., the press recessed portion 37 extends to the side end surface 34, 35) or 0.4 mm≦C≦0.8 mm in view of the durability as shown in FIG. 17 and in view of the moldability.

A-7. Evaluation Value of Width K

FIG. 18 is a diagram showing the results of an evaluation test to examine the influence of the width K on durability performance. In FIG. 18, the test results are plotted with the width K on the horizontal axis and the temperature of the front end surface 31 on the vertical axis with the proviso that the width K is 0 when the lateral surface region 362 of the protruding portion 36 extends to the front end surface 31. For the evaluation test of FIG. 18, a plurality of test samples of the spark plug 100 were prepared. The width K from the protruding portion 36 to the front end surface 31 was varied from sample to sample. In each of the test samples of the spark plug 100, the thickness T of the ground electrode 30 was set to 1.5 mm; the electrode width W of the ground electrode 30 was set to 2.8; the protrusion amount A of the protruding portion 36 was set to 0.7 mm; the diameter of the protruding portion 36 was set to 1.5 mm; the depth of the press recessed portion 37 was set to 0.7 mm; the width of the press recessed portion 37 was set to 1.7 mm; and the width C from the side face 34, 35 of the ground electrode 30 to the press recessed portion 37 was set to 0.5 mm. The test results of FIG. 18 were obtained by subjecting these test samples of the spark plug 100 to 1000 cycles of heating with a burner at 950° C. for 2 minutes and cooling at room temperature for 1 minute, and then, measuring the temperature of a part of the front end surface 31 located closer to the bottom surface region 371.

It has been shown by the test results of FIG. 18 that the temperature of the front end surface 31 sharply increases to an acceptable limit of 1000° C. or higher when the width K becomes greater than 0.4 mm. It is thus preferable that the width K satisfies 0 mm≦K≦0.4 mm.

A-8. Evaluation Value of Distance F

FIG. 19 is a diagram showing the results of an evaluation test to examine the influence of the distance F on moldability. In FIG. 19, the table lists the distance F of location of the bottom end region 364 of the protruding portion 36 inside the lateral surface region 372 of the press recessed portion 37 and the rate of occurrence of a crack(s) in the ground electrode 30 at the time of extrusion pressing the ground electrode 30 with respect to the distance F. Herein, the distance F takes a negative value when the protruding portion 36 protrudes to the outside of the press recessed portion 37 as viewed from the side of the back surface 33. In the evaluation test of FIG. 19, the distance F was changed by adjusting the diameter of the protruding portion 36; the thickness T of the ground electrode 30 was set to 1.5 mm; the electrode width W of the ground electrode 30 was set to 2.8 mm; the depth of the press recessed portion 37 was set to 1.0 mm; and the width of the press recessed portion 37 was set to 1.7 mm. A plurality of test samples of the ground electrode 30, which varied in distance F, were subjected to extrusion pressing and then tested for the occurrence or non-occurrence of a crack(s) in the evaluation test of FIG. 19.

It has been shown by the test results of FIG. 19 that the crack occurrence rate sharply increases when the distance F becomes negative in value. It is thus preferable that the distance F is greater than or equal to 0 mm.

A-9. Effects

As discussed above, the spark plug 100 is so configured that the protrusion amount A of the protruding portion 36 satisfies the relationship of 0.4 mm≦A≦1.0 mm and that press recessed portion 37 extends to and reaches the front end surface 31 of the ground electrode 30 whereby the thermal radiation characteristics of the front end surface 31 of the ground electrode 30 can be increased effectively. It is thus possible to improve the durability of the spark plug 100 with the press-worked ground electrode 30.

As the width C from the side end surface 34, 35 of the ground electrode 30 to the press recessed portion 37 satisfies the relationship of 0.4 mm≦C≦0.8 mm, not only the thermal radiation characteristics of the part from the front end surface 31 of the ground electrode 30 to the press recessed portion 37 but also the thermal radiation characteristics of the part from the side end surface 34, 35 of the ground electrode 30 to the press recessed portion 37 can be increased effectively. It is thus possible to further improve the durability of the spark plug 100 with the press-worked ground electrode 30.

Not only the thermal radiation characteristics of the front end surface 31 of the ground electrode 30 but also the thermal radiation characteristics of the side face 34, 35 of the ground electrode 30 can be increased effectively as the press recessed portion 37 extends to both of the front end surface 31 and the side faces 34 and 35 of the ground electrode 30. It is thus possible to further improve the durability of the spark plug 100 with the press-worked ground electrode 30.

The thermal radiation characteristics of the front end surface 31 of the ground electrode 30 can be further increased as the width K from the front end surface 31 of the ground electrode 30 to the protruding portion 36 satisfies the relationship of 0 mm≦K≦0.4 mm.

Moreover, the protruding portion 36 is located inside the press recessed portion 37 when viewed from the direction facing the center electrode 20. This leads to displacement of the position of the protruding portion 36 from a direction of shear force radially exerted from the corner region 374 of the press recessed portion 37 at the time of extrusion pressing of the ground electrode 30 so that the occurrence of a crack in the protruding portion 36 and periphery thereof can be prevented effectively. It is thus possible to further improve the durability of the spark plug 100 with the press-worked ground electrode 30.

B. Other Embodiments

Although the present invention has been described above with reference to the specific embodiments, the present invention is not limited to the above-described embodiments. It is needless to say that various modification and variation of the embodiments described above will occur to those skilled in the art without departing from the scope of the present invention. For example, the bottom end region 364 of the protruding portion 36 and the corner region 374 of the press recessed portion 37 may be provided in the form of corners chamfered at an angle of about 45° or curved rounded corners. Depending on the embodiment, the protruding portion 36 and the press recessed portion 37 of the ground electrode 30 can modified to any shapes such as polygonal shapes e.g. circular shapes, rectangular shapes, oval shapes, triangular shapes etc. or shapes defined by multiple curved lines.

The invention claimed is:

1. A spark plug, comprising:

a shaft-shaped center electrode;

a ceramic insulator holding an outer circumference of the center electrode;

a metal shell holding an outer circumference of the ceramic insulator; and a ground electrode joined to the metal shall so as to define a spark gap between the center electrode and the ground electrode, the ground electrode having an opposing surface facing a front end of the center electrode, a back surface located opposite from the front end of the center electrode, a protruding portion formed on the opposing surface by extrusion pressing and protruding from the opposing surface toward the front end of the center electrode and a press recessed portion made in the back surface due to the formation of the protruding portion by extrusion pressing and recessed from the back surface toward the front end of the center electrode, wherein a protrusion amount A of the protruding portion from the opposing surface satisfies a relationship of 0.4 mm≦A≦1.0 mm;

wherein the press recessed portion extends to a front end of the ground electrode and has a bottom surface region substantially in parallel with the back surface, a lateral surface region extending from the bottom surface region in a direction facing away from the center electrode and along which the press recessed portion is recessed from the back surface toward the opposing surface; and wherein there is a hollow recessed space defined and surrounded by the bottom surface region, the lateral surface region and a corner region extending from the bottom surface region to the lateral surface region.

2. The spark plug according to claim 1, wherein the press recessed portion extends to both of the front end and the side end of the ground electrode.

3. A spark plug comprising:

a shaft-shaped center electrode;

a ceramic insulator holder an outer circumference of the center electrode;

a metal shell holding an outer circumference of the ceramic insulator; and a ground electrode joined to the metal shall so as to define a spark gap between the center electrode and the ground electrode, the ground electrode having an opposing surface facing a front end of the center electrode, a back surface located opposite from the front end of the center electrode, a protruding portion formed on the opposing surface by extrusion pressing and protruding from the opposing surface toward the front end of the center electrode and a press recessed portion made in the back surface due to the formation of the protruding portion by extrusion pressing and recessed from the back surface toward the front end of the center electrode, wherein a protrusion amount A of the protruding portion from the opposing surface satisfies a relationship of 0.4 mm≦A≦1.0 mm;

wherein the press recessed portion extends to a front end of the ground electrode; and wherein a width C from a side end of the ground electrode to the press recessed portion satisfies a relationship of 0.4 mm≦C≦0.8 mm.

4. A spark plug comprising:

a shaft-shaped center electrode;

a ceramic insulator holder an outer circumference of the center electrode;

a metal shell holding an outer circumference of the ceramic insulator; and a ground electrode joined to the metal shall so as to define a spark gap between the center electrode and the ground electrode, the ground electrode having an opposing surface facing a front end of the center electrode, a back surface located opposite from the front end of the center electrode, a protruding portion formed on the opposing surface by extrusion pressing and protruding from the opposing surface toward the front end of the center electrode and a press recessed portion made in the back surface due to the formation of the protruding portion by extrusion pressing and recessed from the back surface toward the front end of the center electrode, wherein a protrusion amount A of the protruding portion from the opposing surface satisfies a relationship of 0.4 mm≦A≦1.0 mm;

wherein the press recessed portion extends to a front end of the ground electrode; and wherein a width K from the front end of the ground electrode to the protruding portion satisfies a relationship of 0 mm≦K≦0.4 mm.

5. A spark plug comprising:

a shaft-shaped center electrode;

a ceramic insulator holder an outer circumference of the center electrode;

a metal shell holding an outer circumference of the ceramic insulator; and a ground electrode joined to the metal shall so as to define a spark gap between the center electrode and the ground electrode, the ground electrode having an opposing surface facing a front end of the center electrode, a back surface located opposite from the front end of the center electrode, a protruding portion formed on the opposing surface by extrusion pressing and protruding from the opposing surface toward the front end of the center electrode and a press recessed portion made in the back surface due to the formation of the protruding portion by extrusion pressing and recessed from the back surface toward the front end of the center electrode, wherein a protrusion amount A of the protruding portion from the opposing surface satisfies a relationship of 0.4 mm≦A≦1.0 mm;

wherein the press recessed portion extends to a front end of the ground electrode; and wherein the protruding portion is located inside the press recessed portion when viewed from a direction in which the protruding portion faces the center electrode.

6. A manufacturing method of a spark plug, the spark plug including a shaft-shaped center electrode, a ceramic insulator holding an outer circumference of the center electrode, a metal shell holding an outer circumference of the ceramic insulator and a ground electrode joined to the metal shell so as to define a spark gap between the center electrode and the ground electrode, the manufacturing method comprising:

forming a protruding portion by extrusion pressing on an opposing surface of the ground electrode facing a front end of the center electrode in such a manner that the protruding portion protrudes from the opposing surface toward the front end of the center electrode and that a protrusion amount A of the protruding portion from the opposing surface satisfies a relationship of 0.4 mm≦A≦1.0 mm; and forming a press recessed portion in a back surface of the ground electrode located opposite from the front end of the center electrode in such a manner that the press recessed portion is recessed from the back surface toward the front end of the center electrode and extends to a front end of the ground electrode.

7. A spark plug, comprising:

a shaft-shaped center electrode;

a ceramic insulator holding an outer circumference of the center electrode;

a metal shell holding an outer circumference of the ceramic insulator; and a ground electrode joined to the metal shall so as to define a spark gap between the center electrode and the ground electrode, the ground electrode having an opposing surface facing a front end of the center electrode, a back surface located opposite from the front end of the center electrode, a protruding portion formed on the opposing surface by extrusion pressing and protruding from the opposing surface toward the front end of the center electrode and a press recessed portion made in the back surface due to the formation of the protruding portion by extrusion pressing and recessed from the back surface toward the front end of the center electrode, wherein a protrusion amount A of the protruding portion from the opposing surface satisfies a relationship of 0.4 mm≦A≦1.0 mm;

wherein the press recessed portion extends to a front end of the ground electrode and has a bottom surface region substantially in parallel with the back surface, a lateral surface region extending from the bottom surface region substantially along the direction in which the press recessed portion is recessed from the back surface toward the opposing surface and a corner region extending from the bottom surface region to the lateral surface region, the lateral surface region of the press recessed portion being formed substantially perpendicular to the bottom surface region of the press recessed portion.

8. A spark plug, comprising:

a shaft-shaped center electrode;

a ceramic insulator holding an outer circumference of the center electrode;

a metal shell holding an outer circumference of the ceramic insulator; and a ground electrode joined to the metal shall so as to define a spark gap between the center electrode and the ground electrode, the ground electrode having an opposing surface facing a front end of the center electrode, a back surface located opposite from the front end of the center electrode, a protruding portion formed on the opposing surface by extrusion pressing and protruding from the opposing surface toward the front end of the center electrode and a press recessed portion made in the back surface due to the formation of the protruding portion by extrusion pressing and recessed from the back surface toward the front end of the center electrode, wherein a protrusion amount A of the protruding portion from the opposing surface satisfies a relationship of 0.4 mm≦A≦1.0 mm;

wherein the press recessed portion extends to a front end of the ground electrode and has a bottom surface region substantially in parallel with the back surface, a lateral surface region extending from the bottom surface region substantially along the direction in which the press recessed portion is recessed from the back surface toward the opposing surface and a corner region extending from the bottom surface region to the lateral surface region, the corner region of the press recessed portion being formed into a substantially right-angle corner.

* * * * *